US009376738B2

(12) United States Patent
Teramoto et al.

(10) Patent No.: US 9,376,738 B2
(45) Date of Patent: Jun. 28, 2016

(54) HOT FORGING USE NON-HEAT-TREATED STEEL AND HOT FORGED NON-HEAT-TREATED STEEL PART

(75) Inventors: Shinya Teramoto, Tokyo (JP); Kei Miyanishi, Tokyo (JP); Masayuki Hashimura, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 73 days.

(21) Appl. No.: 12/311,821

(22) PCT Filed: Oct. 27, 2008

(86) PCT No.: PCT/JP2008/069835

§ 371 (c)(1),
(2), (4) Date: Apr. 13, 2009

(87) PCT Pub. No.: WO2009/057731

PCT Pub. Date: May 7, 2009

(65) Prior Publication Data

US 2010/0183473 A1 Jul. 22, 2010

(30) Foreign Application Priority Data

Oct. 29, 2007 (JP) ..... 2007-280258

(51) Int. Cl.
*C22C 38/60* (2006.01)
*C22C 38/18* (2006.01)
(Continued)

(52) U.S. Cl.
CPC . *C22C 38/06* (2013.01); *C21D 1/25* (2013.01); *C21D 7/13* (2013.01); *C22C 38/02* (2013.01); *C22C 38/04* (2013.01); *C22C 38/38* (2013.01); *C21D 8/06* (2013.01); *C21D 2211/004* (2013.01); *C21D 2211/008* (2013.01)

(58) Field of Classification Search
None
See application file for complete search history.

(56) References Cited

U.S. PATENT DOCUMENTS

2006/0185774 A1* 8/2006 Nishibata et al. ..... 148/653

FOREIGN PATENT DOCUMENTS

JP 55-082749 6/1980
JP 55-082750 6/1980
(Continued)

OTHER PUBLICATIONS

English translation of Isobe, JP2008-174830 (2008).*
(Continued)

*Primary Examiner* — Yoshitoshi Takeuchi
(74) *Attorney, Agent, or Firm* — Kenyon & Kenyon LLP

(57) ABSTRACT

The present invention provides hot forging use non heat-treated steel where controlled cooling after shaping by hot forging is used to make the main structure of the steel martensite even without subsequent reheating and heat treatment by quenching and tempering and thereby give a steel part with a high strength and high toughness and superior machineability and a hot forged non heat-treated steel part made of that steel, in particular provides a martensite type hot forging use non heat-treated steel characterized by containing, by mass %, C: 0.10 to 0.20%, Si: 0.10 to 0.50%, Mn: 1.0 to 3.0%, P: 0.001 to 0.1%, S: 0.005 to 0.8%, Cr: 0.10 to 1.50%, Al: over 0.1 to 0.20%, and N: 0.0020 to 0.0080% and having a balance of substantially Fe and unavoidable impurities and a hot forged non heat-treated steel part made of such steel and characterized in that the steel structure of the entire cross-section at part or all of that part is substantially a martensite structure with an effective crystal grain size of 15 μm or less.

3 Claims, 1 Drawing Sheet

(51) Int. Cl.

| | |
|---|---|
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 1/25*** | (2006.01) |
| ***C21D 7/13*** | (2006.01) |
| ***C22C 38/38*** | (2006.01) |
| *C21D 8/06* | (2006.01) |

(56) References Cited

FOREIGN PATENT DOCUMENTS

| | | | | |
|---|---|---|---|---|
| JP | 56-169723 | | 12/1981 | |
| JP | 63-130749 | | 6/1988 | |
| JP | 01-129953 | | 5/1989 | |
| JP | 3-10047 | * | 1/1991 | ..... C22C 38/00 |
| JP | H 5-279788 | * | 10/1993 | ..... C22C 38/00 |
| JP | H0734189 | * | 2/1995 | ..... C22C 38/00 |
| JP | 9-170046 | | 6/1997 | |
| JP | 10-237589 | * | 9/1998 | ..... C22C 38/00 |
| JP | 10237589 | | 9/1998 | |
| JP | 2003-201544 | | 7/2003 | |
| JP | 2003-328079 | * | 11/2003 | ..... C22C 38/00 |
| JP | 2008-13788 | | 1/2008 | |
| JP | 2008013788 | | 1/2008 | |
| JP | 2008-174830 | * | 7/2008 | ..... C22C 38/00 |
| WO | WO 2008/084749 | | 7/2008 | |

OTHER PUBLICATIONS

English translation of JP 2003-328079.*
English translation of JP H03-010047 (1991).*
English translation of JPH 5-279788 (1993).*
English translation of JPH0734189 (1995).*

* cited by examiner

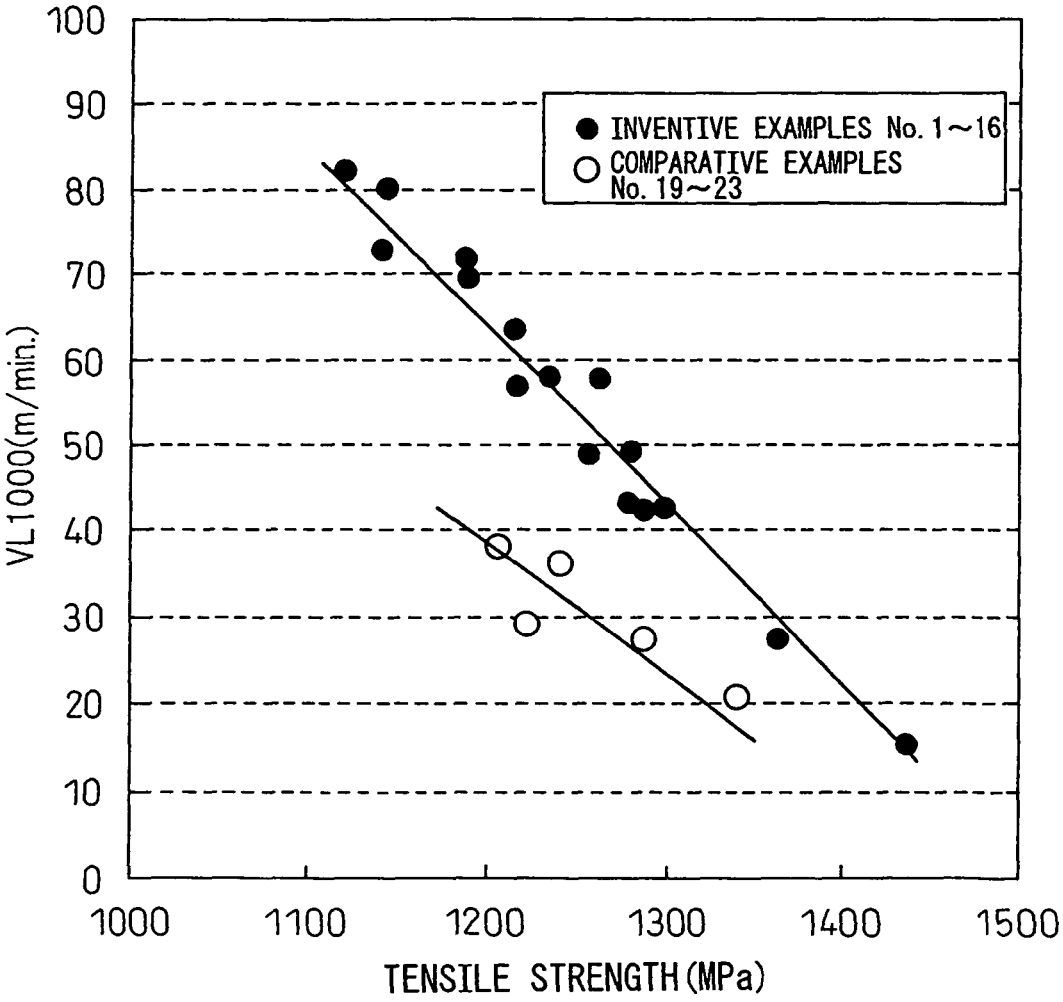
INVENTIVE EXAMPLES No. 1~16
COMPARATIVE EXAMPLES No. 19~23
VL1000(m/min.)
TENSILE STRENGTH (MPa)
100
90
80
70
60
50
40
30
20
10
0
1000
1100
1200
1300
1400
1500

HOT FORGING USE NON-HEAT-TREATED STEEL AND HOT FORGED NON-HEAT-TREATED STEEL PART

CROSS REFERENCE TO RELATED APPLICATIONS

The present application is the national stage application of International Application No. PCT/JP2008/069835, filed on Oct. 27, 2008, which claims priority to JP Application No. 2007-280258, filed on Oct. 29, 2007.

TECHNICAL FIELD

The present invention relates to steel to be worked into a machine part of an automobile, industrial machinery, etc., in particular a martensite type hot forging use non heat-treated steel in which controlled cooling after shaping by hot forging is used to make the main structure martensite and in which strength and toughness and also machineability are improved even without heat treatment of quenching and tempering after hot forging, and to that a forged non heat-treated steel part made of that steel.

BACKGROUND ART

In the past, most machine parts of automobiles, industrial machinery, etc. have generally been made by hot forging steel rods made of medium carbon steel or low carbon steel into the part shapes, then reheating them and heat treating them by quenching and tempering to thereby impart high strength and high toughness.

However, this heat treatment requires tremendous heat energy. Further, the treatment steps increase and the semifinished parts increase etc., so the ratio of heat treatment costs in the costs of production of parts becomes greater. For this reason, to simplify the production process and lower the heat treatment costs when producing such structural parts, hot forging use non heat-treated steel omitting the heat treatment of quenching and tempering has been developed.

Hot forged parts made using non heat-treated steel have been heated once to 1200° C. or more and forged at a high temperature of 1000 to 1200° C. or so. However, heating at 1200° C. or more causes the austenite grains to become coarser. By forging at a high temperature of 1000 to 1200° C., recrystallization progresses after working, the ferrite-pearlite obtained in the cooling process becomes coarser, and therefore hot forging non heat-treated parts using non heat-treated steel generally become smaller in yield strength ratio and impact value compared with heat-treated steel parts.

To solve these problems, Japanese Patent Publication (A) No. 55-82749 describes to increase the amount of Mn of the steel for use in machine structures and further add a small amount of V, Japanese Patent Publication (A) No. 55-82750 describes to add a small amount of V to steel for use in machine structures, and further Japanese Patent Publication (A) No. 56-169723 describes to control the ingredients and also cool in the cooling process after forging by a rate of 0.7° C./sec or less in the temperature range of 1000 to 550° C. so as to make a large amount of intergranular ferrite of cores of MnS disperse in the steel and as a result obtain a fine-grain structure and improve the toughness and fatigue characteristics. However, the ferrite-pearlite obtained by these methods remains coarse and therefore the amount of increase in impact value or strength due to increasing the fineness of the structure is small at the present.

Recently, for protection of the global environment, better fuel economy of automobiles has been increasingly demanded. One of the effective means for achieving better fuel economy of automobiles is reduction of the weight of the vehicles. This is leading to reduction of the size of parts by improvement of part strength. However, the current ferrite-pearlite type non heat-treated steel has a limit of strength of about 1000 MPa. It is becoming impossible to meet the recent demands for higher strength and higher toughness.

On the other hand, to obtain both a 1000 MPa or more strength and a high toughness, it is necessary to make the structure a martensite structure or bainite structure in which carbides are finely dispersed.

Numerous art regarding non heat-treated steel given a martensite or bainite structure as hot forged has been proposed up to now. For example, Japanese Patent Publication (A) No. 1-129953 describes that by making the amount of carbon a relatively low one of 0.04 to 0.20% so as to raise the Ms point aiming at the effect of self tempering and, further, adding Ti, B, and other elements to increase the quenchability and further rapidly cooling after forging to make the structure a martensite or bainite structure or a mixed structure of martensite and bainite, a high strength and a good toughness are obtained. Further, Japanese Patent Publication (A) No. 63-130749 describes increasing the N without adding Ti and B and rapidly cooling from the $Ar_3$ point or more.

However, with the high strength disclosed in these Japanese Patent Publication (A) No. 1-129953 and Japanese Patent Publication (A) No. 63-130749, there is little effect of improvement of the machineability even if adding Ca, Te, Bi, or other machineability improving elements.

Further, Japanese Patent Publication (A) No. 2000-129393 discloses the discovery that by adding suitable amounts of Mn and Cu together, a high yield strength and good toughness are obtained and that by adding suitable amounts of Ti and Zr and making Ti carbosulfides and Zr carbosulfides finely disperse, the amount of formation of MnS is reduced and in turn the machineability of the steel material is improved. However, Ti carbosulfides and Zr carbosulfides are hard, so sometimes cause tool damage and promote tool wear at the time of machining. Whatever the case, it is not easy to obtain steel and machine parts with high strength and high toughness and with superior machineability.

DISCLOSURE OF THE INVENTION

In recent years, due to the demands for improved fuel efficiency through lighter weight of vehicles, higher strength of hot forged non heat-treated steel parts for automobiles has been sought. The increase in strength of such non heat-treated steel parts is accompanied with the problem, as explained above, of the drop in toughness and machineability. In the prior art explained above, it was however not easy to improve the machineability in addition to mechanical properties such as the strength and toughness.

Therefore, the present invention has as its object to solve these problems and to provide hot forging use non heat-treated steel in which the controlled cooling after shaping by hot forging is used to make the main structure of the steel martensite even without subsequent reheating and heat treatment by quenching and tempering and thereby improved in not only mechanical properties such as strength and toughness but also machineability and provide hot forged non heat-treated steel parts made of that steel.

To make the main structure martensite by controlled cooling after shaping by hot forging without the conventional heat treatment by quenching and tempering and thereby achieve the higher toughness and good machineability of a martensite type non heat-treated steel, the inventors engaged in various studies on the optimal ingredients and structure of steel and as a result discovered that by adding, among the steel ingredients, in particular Al in an amount more than the amount of Al of ordinary hot forging use steel and adding N in an amount smaller than the amount of N of ordinary hot forging use steel, the following are possible and thereby improved not only the mechanical properties of strength and toughness, but also machineability in martensite type non heat-treated steel in a wide range of cooling rates:

1) By the increase in the amount of solute Al, a high strength plus a high machineability can be obtained.

2) By the increase in solute Al, the coarsening of the effective crystal grains, the units of breakage, can be suppressed and a high toughness secured and, even in the case of a slow cooling rate, Al nitrides finely precipitate uniformly during the cooling, coarsening of the effective crystal grains is suppressed, and a high strength plus a high toughness can be secured.

The present invention was made based on these discoveries and provides a martensite type hot forging use non heat-treated steel having a high strength and high toughness and improved in machineability and provides a hot forged non heat-treated steel part made of that steel. It has as its gist the following:

(1) A martensite type hot forging use non heat-treated steel characterized by containing, by mass %, C: 0.10 to 0.20%, Si: 0.10 to 0.50%, Mn: 1.0 to 3.0%, P: 0.001 to 0.1%, S: 0.005 to 0.8%, Cr: 0.10 to 1.50%, Al: over 0.1 to 0.20%, and N: 0.0020 to 0.0080% and having a balance of substantially Fe and unavoidable impurities.

(2) A martensite type hot forging use non heat-treated steel as set forth in (1) further containing, by mass %, B: 0.0005 to 0.0050% and Ti: 0.005 to 0.030%.

(3) A martensite type hot forging use non heat-treated treated steel as set forth in (1) or (2) further containing, by mass %, one or more of Nb: 0.05 to 0.30%, V: 0.05 to 0.30%, and Mo: 0.05 to 1.0%.

(4) A hot forged non heat-treated steel part made of a martensite type hot forging use non heat-treated steel as set forth in any one of (1) to (3), said hot forged non heat-treated steel part characterized in that the steel structure of the entire cross-section at part or all of that part is substantially a martensite structure with an effective crystal grain size of 15 μm or less.

(5) A hot forged non heat-treated steel part as set forth in (4) characterized in that an amount of solute Al is 0.05 to 0.18 mass % in the steel at a location where the steel structure of the entire cross-section at part or all of that part is substantially a martensite structure with an effective crystal grain size of 15 μm or less.

BRIEF DESCRIPTION OF THE DRAWINGS

FIG. 1 is a view showing the relationship between the tensile strength and machineability of Invention Example Nos. 1 to 16 and Comparative Example Nos. 19 to 23 of Table 3.

BEST MODE FOR CARRYING OUT THE INVENTION

The present invention anticipates that by the controlled cooling after hot forging, the structure will become martensite. In particular, as steel ingredients, by adding Al in an amount of more than 0.1 to 0.20%, which is more than in ordinary non heat-treated steel, coarsening of the effective crystal grains, which are units of breakage, is suppressed and high toughness is secured, while by further including N in an amount of 0.0020 to 0.0080%, which is lower than ordinary non heat-treated treated steel, the amount of solute Al increases and the machineability is improved.

Further, the present invention, by using the steel ingredients explained above, obtains a hot forging use non heat-treated steel part which uses controlled cooling after hot forging to obtain a substantially martensite structure having an effective crystal grain size of 15 μm or less and which exhibits high strength and high toughness and improves the machineability without heat treatment by quenching and tempering.

First, the reasons for limitation of the alloy ingredients of the steel in claims 1 to 3 will be explained below.

The martensite type hot forging use non heat-treated steel as set forth in claim 1 according to the present invention is suitable for a relatively small sized or thin part which can be sufficiently quenched or parts not requiring an internal hardness as much as the surface part, for example, is particularly suitable when used for a crankshaft used for an automobile engine etc., a connecting rod, a knuckle arm used for an automobile chassis, and other structural parts.

Further, the martensite type hot forging use non heat-treated steel defined in claim 2 can be used for a part relatively large in size or requiring sufficient quenchability. The martensite type hot forging use non heat-treated steel defined in claim 3 can be applied to a part requiring further higher strength and higher toughness than the steel produced by claims 1 and 2.

[Ingredients Defined in Claim 1]

C: 0.10 to 0.20%

C is the most basic element determining the quenchability of steel and the strength of martensite steel and parts. To obtain sufficient strength of the steel and parts, the lower limit is made 0.10%, preferably the lower limit is made 0.14%. On the other hand, to raise the Ms point and obtain self tempering in the forging and quenching process, the upper limit is made 0.20%. Further, if over 0.20%, the toughness falls. This point is the reason for making the upper limit of C 0.20%.

Si: 0.10 to 0.50%

Si is an element for securing the strength of the material by solution strengthening and effective as a deoxidizing element, but if less than 0.10%, those effects are not expressed and, further, sufficient preliminary deoxidation cannot be performed. For this reason, the lower limit of Si was made 0.10%. On the other hand, if over 0.50%, hard oxides are formed causing the toughness and machineability to fall and other problems to arise. For this reason, the upper limit of Si was made 0.50%.

Mn: 1.0 to 3.0%

Mn is an element strengthening the steel by solution strengthening and improving the quenchability and further is an element effective in promoting the formation of martensite. If this Mn is less than 1.0%, it is not possible to obtain the desired martensite structure, so the lower limit was made 1.0%. Further, this Mn is an element useful for preventing hot embrittlement by S. This is necessary to fix the S in the steel as sulfides and make it disperse in it, but if the amount of Mn becomes large, the hardness of the material becomes greater and the toughness and machineability fall, so the upper limit was made 3.0%.

P: 0.001 to 0.1%

P is an element with the effect of improvement of the machineability by the hardness of the steel material becoming greater and embrittlement being caused, but if less than 0.001%, the above-mentioned effect cannot be sufficiently obtained. Further, if over 0.1%, the steel material will become too hard and conversely the toughness will be degraded, so the upper limit is made 0.1%.

S: 0.005 to 0.8%

S is an element forming MnS and improving the machineability, but if less than 0.005%, a sufficient effect is not obtained. On the other hand, while depending on the amount of Mn as well, if over 0.8%, the MnS will become coarser and, along with this, anisotropy will occur in the MnS at the time of forging, so the anisotropy of the mechanical properties will become greater and in some cases cracks will be started and the workability degraded. For this reason, the content of S was made 0.005 to 0.8%.

Cr: 0.10 to 1.50%

Cr is an element raising the quenchability and, further, improving the strength and toughness. If less than 0.10%, these effects are not obtained. Further, if over 1.5%, not only do the effects become saturated, but also Cr carbides are formed conversely causing the toughness to fall and the machineability to fall. For this reason, the content of Cr was made 0.10 to 1.50%.

Al: Over 0.1 to 0.20%

Al is an element effective for deoxidation. Further, it is present as a solute and nitride in the austenite or martensite at the time of a high temperature, suppresses the coarsening of the effective crystal grains of the units of breakage, and maintains the high toughness. Further, the solute Al in the steel has the effect of improving the machineability. To sufficiently exhibit this effect, addition of over 0.1% is necessary. However, if excessively added, hard oxides are formed and conversely a drop in the toughness and machineability is invited. For this reason, the content of Al was made over 0.1 to 0.20%.

N: 0.0020 to 0.0080%

N forms nitrides with various types of elements and has the effect of suppressing coarsening of effective crystal grains and maintaining a high toughness. To obtain these full effects, the lower limit is made 0.0020%. However, if excessively adding this N, a large amount of AlN precipitates and the AlN becomes coarsened and the solute Al falls. Therefore, the upper limit is made 0.0080%, preferably 0.0060% or less, more preferably 0.0050% or less.

[Ingredients Defined in Claim 2]

B: 0.0005 to 0.0050%

B, if present as solute B in the steel, has the effects of enhancing the effect of improving the quenchability and, further, improving the toughness. To obtain these effects, 0.0005% or more is necessary, but if over 0.0050%, these effects also become saturated and the toughness is lowered. For this reason, the content of B was made 0.0005 to 0.0050%.

Ti: 0.005 to 0.030%

Ti bonds with the N entering as an unavoidable impurity to thereby form Ti nitrides which suppress the precipitation of BN to increase the solute B and prevent B from becoming BN and the effect of improvement of quenchability of B from being lost and therefore can improve the effect of improvement of the quenchability by B. Further, it has the effect of forming Ti nitrides and suppress the coarsening of the effective crystal grains and maintaining a high toughness. To obtain these effects, 0.005% or more is necessary. However, if over 0.030%, coarse Ti nitrides are formed and conversely the toughness falls and, further, the machineability falls. For this reason, the content of Ti was made 0.005 to 0.030%.

[Ingredients Defined in Claim 3]

Nb: 0.05 to 0.30%

Nb forms Nb carbonitrides and has the effects of suppressing coarsening of the effective crystal grains and maintaining the high toughness and high strength. Further, it dissolves in the steel at a high temperature and increases the quenchability. To obtain these effects, 0.05% or more is necessary. However, if over 0.30%, coarse Nb carbonitrides are formed and conversely the toughness is reduced. For this reason, the content of Nb was made 0.05 to 0.30%.

V: 0.05 to 0.30%

V, like Nb, has the effect of forming V carbonitrides, suppressing the coarsening of the effective crystal grains, and maintaining a high toughness. Further, it dissolves in the steel at a high temperature and increases the quenchability. To obtain these effects, 0.05% or more is necessary. However, if over 0.30%, coarse V carbonitrides are formed and conversely the toughness falls. For this reason, the content of V was made 0.05 to 0.30%.

Mo: 0.05 to 1.0%

Mo is an element contributing to the improvement of the quenchability and effectively inhibiting a drop in grain boundary strength by carbides. If less than 0.05%, these effects cannot be observed, while even if added over 1.0%, the effects become saturated. For this reason, the content of Mo was made 0.05 to 1.0%.

Further, in addition to the above steel ingredients defined in the present invention, it is also possible to include Sn, Zn, Pb, Sb, REM, etc. in a range not impairing the effects of the present invention.

Next, the hot forged non heat-treated steel parts of the present invention are characterized in that, depending on the parts, there are parts with locations in the part where a high strength and toughness are required and locations where they are not required and there are parts where the part as a whole requires a high strength and toughness. The present invention makes the steel structure of the entire cross-section at a location of all or part of that part where a high strength and toughness are required substantially a martensite structure with an effective crystal grain size of 15 μm or less. The reason for the above limitation at a location of part or all of a part where a high strength and toughness are required will be explained below.

When hot forging, then cooling using the martensite type hot forging use non heat-treated steel as set forth in claims 1 to 3, the part is cooled by water cooling, oil cooling, air cooling, or a cooling medium having a cooling ability equivalent to the same in accordance with the thickness of the forged part or the amount of addition of the alloy elements so that the steel structure becomes substantially a self tempered martensite structure having an effective crystal grain size of 15 μm or less. When the steel structure is other than a martensite structure, the toughness remarkably falls. Here, "substantially a martensite structure" means the case where, by area ratio, 95% or more is a martensite structure. The balance includes bainite, pearlite, residual austenite, etc. and is not particularly limited.

Here, the "effective crystal grain size" is the average length of one flat brittle fracture surface formed by quasi-cleavage or cleavage when observing a brittle fracture surface after a Charpy test. The steel structure is made a martensite structure with an effective crystal grain size of 15 μm or less to achieve both a strength of 1100 MPa or more and a high toughness.

To make the steel structure substantially a martensite structure having an effective crystal grain size of 15 μm or less, as explained above, at the time of cooling after hot forging, water cooling, oil cooling, or air cooling means may be suitably selected in accordance with the cooling rate, the steel ingredients, and the thickness of the forged part. For example, in the case of a martensite type hot forging use non heat-treated steel with steel ingredients with little elements improving the quenchability and satisfying claim 1 and a forged part with a thickness of a thick 40 mm or more, water cooling is selected, while in the case of a martensite type hot forging use non heat-treated steel with steel ingredients with large elements improving the quenchability and simultaneously satisfying claims 2 and 3 and a forged part with a thickness of a thick 20 mm or less, water cooling, oil cooling, or air cooling may be selected. The suitable conditions may be found in advance by experiments.

In the hot forged non heat-treated steel part in the present invention, by inclusion, by mass %, of solute Al: 0.05 to 0.18%, it is possible to make the steel material brittler and improve the machineability. However, if less than 0.05%, the above effect cannot be sufficient obtained. On the other hand, the amount of solute Al is determined by the amount of Al and amount of N in the steel, the heating temperature, etc., but over 0.18% cannot be dissolved. To make the amount of solute Al 0.05% or more, the heating temperature before hot forging has to be made 1150° C. or more, preferably 1200° C. or more, more preferably 1250° C. or more.

Note that the location where the amount of solute Al is made as explained above is a location in the part which at least is hot forged and cooled so that the steel structure becomes substantially a martensite structure with an effective crystal grain size of 15 μm or less, but other locations may also have the above amount of solute Al.

The present invention will be explained in detail below using examples.

Example 1

150 kg of each steel having the chemical ingredients shown in Table 1 was produced in a vacuum melting furnace, then hot rolled to obtain a steel rod of a diameter of 50 mm. Next, to secure the amount of solute Al in the steel, this was hot forged at a heating temperature of 1250° C. and drawn to a cylindrical shape of a diameter of 20 mm. In all cases other than the Invention Example No. 13 and No. 14 and Comparative Example No. 22 and No. 23, 25° C. water was immediately used for cooling. For Invention Example No. 13 and No. 14 and Comparative Example No. 22 and No. 23, 100° C. oil (JIS Type 1 No. 1) was immediately used for cooling. That is, for No. 13, No. 14, No. 22, and No. 23, the cooling rate was slowed. Further, the steels of the invention examples and comparative examples were tested by tensile tests, impact tests, and machineability tests to evaluate their properties. Note that the underlines in Table 1 show conditions outside the scope defined by the present invention.

Incidentally, Nos. 17 and 18 had contents of C outside the range prescribed by the present invention, Nos. 19, 20, 22, and 23 had contents of Al outside it, No. 21 had a content of N outside it, No. 24 had a content of Si outside it, Nos. 25 and 26 had contents of Mn outside it, No. 27 had a content of Cr outside it, No. 28 had contents of Ti and B outside it, and No. 29 had a content of P outside it.

TABLE 1

| No. | C | Si | Mn | P | S | Cr | Al | N | Ti | B | Nb | V | Mo | Class |
|---|---|---|---|---|---|---|---|---|---|---|---|---|---|---|
| 1 | 0.14 | 0.21 | 1.62 | 0.038 | 0.066 | 0.66 | 0.135 | 0.0029 | — | — | — | — | — | Inv. ex. |
| 2 | 0.20 | 0.21 | 1.72 | 0.022 | 0.070 | 0.45 | 0.108 | 0.0029 | — | — | — | — | — | Inv. ex. |
| 3 | 0.15 | 0.13 | 2.22 | 0.035 | 0.072 | 0.56 | 0.137 | 0.0056 | — | — | — | — | — | Inv. ex. |
| 4 | 0.14 | 0.48 | 1.92 | 0.030 | 0.071 | 0.63 | 0.158 | 0.0031 | — | — | — | — | — | Inv. ex. |
| 5 | 0.16 | 0.28 | 1.07 | 0.021 | 0.066 | 0.40 | 0.121 | 0.0059 | — | — | — | — | — | Inv. ex. |
| 6 | 0.16 | 0.29 | 2.93 | 0.022 | 0.057 | 0.61 | 0.127 | 0.0025 | — | — | — | — | — | Inv. ex. |
| 7 | 0.16 | 0.25 | 1.93 | 0.027 | 0.077 | 0.12 | 0.158 | 0.0045 | — | — | — | — | — | Inv. ex. |
| 8 | 0.15 | 0.29 | 1.76 | 0.022 | 0.053 | 1.46 | 0.119 | 0.0026 | — | — | — | — | — | Inv. ex. |
| 9 | 0.14 | 0.28 | 2.04 | 0.042 | 0.063 | 0.33 | 0.109 | 0.0059 | — | — | — | — | — | Inv. ex. |
| 10 | 0.15 | 0.25 | 1.80 | 0.042 | 0.075 | 0.48 | 0.182 | 0.0058 | — | — | — | — | — | Inv. ex. |
| 11 | 0.14 | 0.28 | 2.29 | 0.023 | 0.059 | 0.41 | 0.142 | 0.0058 | — | — | — | — | — | Inv. ex. |
| 12 | 0.14 | 0.22 | 1.97 | 0.026 | 0.054 | 0.66 | 0.137 | 0.0076 | — | — | — | — | — | Inv. ex. |
| 13 | 0.16 | 0.23 | 1.92 | 0.023 | 0.051 | 0.59 | 0.117 | 0.0047 | 0.022 | 0.002 | — | — | — | Inv. ex. |
| 14 | 0.17 | 0.29 | 1.63 | 0.036 | 0.062 | 0.60 | 0.134 | 0.0040 | 0.027 | 0.004 | 0.05 | 0.12 | — | Inv. ex. |
| 15 | 0.15 | 0.22 | 1.51 | 0.028 | 0.058 | 0.44 | 0.125 | 0.0049 | — | — | 0.26 | — | 0.20 | Inv. ex. |
| 16 | 0.15 | 0.20 | 1.54 | 0.039 | 0.041 | 0.31 | 0.128 | 0.0042 | — | — | — | 0.28 | — | Inv. ex. |
| 17 | 0.03 | 0.27 | 1.90 | 0.032 | 0.071 | 0.42 | 0.101 | 0.0028 | — | — | — | — | — | Comp. ex. |
| 18 | 0.27 | 0.22 | 1.93 | 0.023 | 0.044 | 0.64 | 0.142 | 0.0043 | — | — | — | — | — | Comp. ex. |
| 19 | 0.17 | 0.28 | 2.13 | 0.042 | 0.076 | 0.47 | 0.022 | 0.0040 | — | — | — | — | — | Comp. ex. |
| 20 | 0.13 | 0.30 | 2.20 | 0.035 | 0.047 | 0.56 | 0.234 | 0.0035 | — | — | — | — | — | Comp. ex. |
| 21 | 0.12 | 0.24 | 2.10 | 0.032 | 0.044 | 0.45 | 0.128 | 0.0108 | — | — | — | — | — | Comp. ex. |
| 22 | 0.12 | 0.26 | 1.55 | 0.025 | 0.058 | 0.34 | 0.031 | 0.0041 | 0.024 | 0.002 | — | — | — | Comp. ex. |
| 23 | 0.13 | 0.29 | 2.13 | 0.022 | 0.076 | 0.36 | 0.082 | 0.0052 | 0.028 | 0.002 | — | 0.18 | 0.40 | Comp. ex. |
| 24 | 0.15 | 0.68 | 1.86 | 0.023 | 0.049 | 0.39 | 0.152 | 0.0033 | — | — | — | — | — | Comp. ex. |
| 25 | 0.13 | 0.26 | 0.84 | 0.028 | 0.066 | 0.52 | 0.144 | 0.0042 | — | — | — | — | — | Comp. ex. |
| 26 | 0.13 | 0.26 | 3.54 | 0.037 | 0.067 | 0.63 | 0.112 | 0.0033 | — | — | — | — | — | Comp. ex. |
| 27 | 0.17 | 0.26 | 1.72 | 0.027 | 0.046 | 1.78 | 0.137 | 0.0044 | — | — | — | — | — | Comp. ex. |
| 28 | 0.17 | 0.28 | 1.53 | 0.041 | 0.069 | 0.30 | 0.146 | 0.0058 | 0.057 | 0.008 | — | — | — | Comp. ex. |
| 29 | 0.15 | 0.24 | 1.60 | 0.111 | 0.052 | 0.48 | 0.135 | 0.0052 | — | — | — | — | — | Comp. ex. |

* Underlined parts are conditions outside the scope of the present invention.

The tensile strength was evaluated by cutting out a JIS No. 3 test piece from a rod of a diameter of 20 mm and measuring the tensile strength. Further, an impact test piece was tested by cutting out a JIS No. 3 test piece in the forging stretching direction and running a Charpy impact test at room temperature by the method defined in JIS Z 2242. At that time, as evaluation indicators, the absorbed energy per unit area was employed.

The effective crystal grain size was obtained by observing a longitudinal direction cross-section of a brittle fracture surface after a Charpy impact test under a microscope, measuring the length of the straight brittle fracture surface formed by quasi-cleavage or cleavage at 20 points, and taking the average.

As an indicator for evaluation of the machineability, the maximum cutting speed VL1000 (m/mn) enabling cutting to a cumulative depth of hole of 1000 mm in a drilling test was employed. The "VL1000" referred to here is the cutting rate of a drill able to drill a hole of 1000 mm length. The larger the value, the better the machineability shown. The conditions of the drilling test are shown in Table 2.

The steel structure was observed under an optical microscope or a scanning electron microscope. "M" indicates the main structure is a martensite structure. "B" indicates the main structure is a bainite structure. The martensite area ratio is the area ratio of martensite in the total structure and is judged by observing a cross-section of a rod of a diameter of 20 mm in the radial direction under a microscope and image processing the captured photograph of the structure. The amount of solute Al in the steel was made the amount of the total amount of Al in the steel minus the amount of Al present as Al nitrides. The amount of Al present as Al nitrides was measured by an ICP emission spectrometer measuring the residue after electrolytic extraction using the speed method of the constant potential galvanic corrosion method using a non-aqueous electrolyte and a 0.1 μm filter.

Further, the results of these tensile tests, impact tests, and evaluation of machineability are shown in Table 3. The dashes in the results of evaluation of Table 3 show cases in the drilling tests where it was not possible to cut to a cumulative depth of hole of 1000 mm by a cutting rate of 1 m/min.

FIG. 1 plots the tensile strength of Invention Example Nos. 1 to 16 and Comparative Example Nos. 19 to 23 of Table 3 on the abscissa and the results of the VL1000 on the ordinate.

TABLE 2

| Machining conditions | Machining rate | 1 to 90 m/min |
|---|---|---|
| | Feed | 0.25 mm/rev |
| | Cutting fluid | Water-soluble cutting fluid |
| Drill | Drill diameter | ϕ3 mm |
| | Superhard drill | TiAlN coating |
| | Depth of cut | 45 mm |
| Others | Hole depth | 6 mm |
| | Tool life | Until breakage |

TABLE 3

| No. | Tensile strength (MPa) | Absorbed energy (J/cm$^2$) | Effective crystal grain size (μm) | VL1000 (m/min) | Structure | Martensite area ratio (%) | Solute Al am't (mass %) | Class |
|---|---|---|---|---|---|---|---|---|
| 1 | 1140 | 109 | 12.4 | 73 | M | 99 | 0.125 | Inv. ex. |
| 2 | 1436 | 87 | 8.6 | 15 | M | 99 | 0.099 | Inv. ex. |
| 3 | 1118 | 112 | 13.3 | 82 | M | 99 | 0.069 | Inv. ex. |
| 4 | 1363 | 95 | 10.4 | 27 | M | 99 | 0.113 | Inv. ex. |
| 5 | 1142 | 105 | 11.2 | 80 | M | 99 | 0.063 | Inv. ex. |
| 6 | 1286 | 94 | 9.0 | 42 | M | 98 | 0.103 | Inv. ex. |
| 7 | 1186 | 101 | 10.1 | 72 | M | 98 | 0.086 | Inv. ex. |
| 8 | 1188 | 100 | 10.0 | 69 | M | 99 | 0.098 | Inv. ex. |
| 9 | 1297 | 90 | 7.9 | 43 | M | 98 | 0.060 | Inv. ex. |
| 10 | 1212 | 102 | 10.9 | 64 | M | 98 | 0.061 | Inv. ex. |
| 11 | 1255 | 94 | 8.6 | 49 | M | 99 | 0.067 | Inv. ex. |
| 12 | 1259 | 98 | 10.2 | 58 | M | 99 | 0.053 | Inv. ex. |
| 13 | 1278 | 96 | 9.5 | 49 | M | 99 | 0.077 | Inv. ex. |
| 14 | 1214 | 99 | 9.9 | 57 | M | 99 | 0.091 | Inv. ex. |
| 15 | 1232 | 102 | 11.3 | 58 | M | 99 | 0.078 | Inv. ex. |
| 16 | 1277 | 97 | 10.0 | 43 | M | 98 | 0.089 | Inv. ex. |
| 17 | 985 | 109 | 10.5 | 102 | M | 98 | 0.093 | Comp. ex. |
| 18 | 1612 | 12 | 12.9 | — | M | 97 | 0.088 | Comp. ex. |
| 19 | 1340 | 95 | 10.1 | 21 | M | 99 | 0.012 | Comp. ex. |
| 20 | 1221 | 32 | 10.3 | 29 | M | 99 | 0.152 | Comp. ex. |
| 21 | 1287 | 105 | 13.0 | 27 | M | 98 | 0.035 | Comp. ex. |
| 22 | 1205 | 66 | 18.5 | 38 | M | 99 | 0.023 | Comp. ex. |
| 23 | 1238 | 58 | 20.6 | 36 | M | 99 | 0.042 | Comp. ex. |
| 24 | 1522 | 14 | 13.2 | — | M | 98 | 0.113 | Comp. ex. |
| 25 | 1155 | 33 | 12.9 | 65 | B | 42 | 0.089 | Comp. ex. |
| 26 | 1414 | 12 | 11.5 | 8 | M | 98 | 0.103 | Comp. ex. |
| 27 | 1312 | 18 | 10.6 | 28 | M | 99 | 0.087 | Comp. ex. |
| 28 | 1295 | 16 | 9.4 | 37 | M | 99 | 0.068 | Comp. ex. |
| 29 | 1226 | 12 | 12.5 | 48 | M | 98 | 0.075 | Comp. ex. |

* Underlined parts are conditions outside the scope of the present invention.

Nos. 1 to 16 shown in the above Table 3 are invention examples, while Nos. 17 to 29 are comparative examples. As shown in Table 3, the steel materials of the Invention Example Nos. 1 to 16 exhibited good values in all of the evaluation indicators of the tensile strength, absorbed energy, and VL1000. Even compared with the comparative examples, all had a superior machineability when viewed by the same level of strength and a superior strength when viewed by the same level of machineability. It became clear that not only the mechanical properties such as strength and toughness, but also the machineability were improved.

On the other hand, in the steel materials of Comparative Example Nos. 17 to 29, at least one of the three properties used as evaluation indicators was inferior compared to that of the steel materials of the invention examples. Specifically, Comparative Example No. 17 did not contain the essential element of the present invention of C in the necessary amount, so the strength was inferior to that of the present invention materials. Further, Comparative Example No. 18 had the essential element of the present invention of C added in excess, so the strength was higher than the present invention material and the toughness and machineability became very inferior.

Comparative Example Nos. 19, 22, and 23 contained the essential element of the present invention of Al in the necessary amount, but Comparative Example No. 21 had N excessively added, so in all cases the amount of solute Al became less than 0.05 mass %. Further, Comparative Example No. 20 had the essential element of the present invention of Al excessively added, so the hard oxides increased. In each case, as shown in FIG. 1, when viewed by the same level of tensile strength, the VL1000 was very inferior compared with the present invention steel material.

In particular, Nos. 22 and 23 both had structures of 95% of more area ratios of martensite, but the cooling rates were slow, no effect of suppressing coarsening of the effective crystal grains by the Al nitrides was obtained, the effective crystal grain size was over 15 μm in each case and therefore out of the prescribed range, and the toughness was inferior to that of the present invention material. On the other hand, Invention Example Nos. 13 and 14 controlled in contents of Ti and B under substantially the same conditions as Nos. 22 and No. 23 were slow in cooling rates, but an effect of suppressing coarsening of the effective crystal grains by the Al nitrides was obtained, the effective crystal grain size was 15 μm or less, and high toughness was secured.

Comparative Example No. 24 had the essential element of the present invention of Si excessively added, so the strength became higher than the present invention material and the toughness and machineability became very inferior.

Comparative Example No. 25 did not include the essential element of the present invention of Mn in the necessary amount, so the quenchability fell, the main structure became bainite, and the toughness became very inferior to that of the present invention material.

Comparative Example Nos. 26 to 29 had the essential elements of the present invention of Mn, Cr, Ti, B, and P excessively added, so the toughness or machineability became very inferior.

INDUSTRIAL APPLICABILITY

The martensite type hot forging use non heat-treated steel and hot forged non heat-treated steel part using the present invention contain as steel ingredients Al in an amount of over 0.1 to 0.20%, which is more than that of ordinary non heat-treated steel, and N in an amount of 0.0020 to 0.0080%, which is lower than that of ordinary non heat-treated steel, so can improve not only the mechanical properties such as strength and toughness, but also the machineability and therefore exhibit the effect of enabling use for steel to be worked into machine parts of automobiles, industrial machinery, etc. where high strength and high toughness are required and for machine parts made of that steel. In particular, in the present invention, the controlled cooling after shaping by hot forging enables the main structure of the steel to be made martensite even without subsequent reheating and heat treatment by quenching and tempering, so it is possible to reduce the heat treatment costs.

The invention claimed is:

1. A non-heat-treated steel for hot forging consisting of, by mass %,

C: 0.14 to 0.20%,
Si: 0.13 to 0.50%,
Mn: 1.0 to 3.0%,
P: 0.001 to 0.1%,
S: 0.051 to 0.8%,
Cr: 0.56 to 1.50%,
Al: 0.119 to 0.20%,
N: 0.0020 to 0.006%,
optionally, B: 0.0005 to 0.0050% and Ti: 0.005 to 0.030%,
optionally, one or more of V: 0.05 to 0.30% or Mo: 0.05 to 1.0%, and
a balance of Fe and unavoidable impurities.

2. The non-heat-treated steel for hot forging as set forth in claim 1, wherein B: 0.0005 to 0.0050% and
Ti: 0.005 to 0.030% are present in the steel.

3. The non-heat-treated steel for hot forging as set forth in claim 1 or 2, wherein one or more of V: 0.05 to 0.30% or
Mo: 0.05 to 1.0% is present in the steel.

* * * * *